United States Patent [19]

Flowers et al.

[11] 4,146,960

[45] Apr. 3, 1979

[54] THINNING COMB FOR POWERED HAIR TRIMMER

[75] Inventors: Theodore R. Flowers, New Haven; Antonio Pires, Wallingford, both of Conn.

[73] Assignee: Sperry Rand Corporation, Bridgeport, Conn.

[21] Appl. No.: 825,334

[22] Filed: Aug. 17, 1977

[51] Int. Cl.[2] ..... B26B 19/22
[52] U.S. Cl. ..... 30/195; 30/200
[58] Field of Search ..... 30/195, 200, 201

[56] References Cited

U.S. PATENT DOCUMENTS

| | | | |
|---|---|---|---|
| 1,621,572 | 3/1927 | Young | 30/200 |
| 1,908,385 | 5/1933 | Wahl | 30/195 |
| 2,118,850 | 5/1938 | Marcel | 30/195 X |
| 2,814,112 | 11/1957 | Gore | 30/195 X |

*Primary Examiner*—Jimmy C. Peters
*Attorney, Agent, or Firm*—Charles R. Miranda; Joseph S. Failla

[57] ABSTRACT

A powered hair trimmer is described which is provided with a hair thinning comb. The comb guides strands of hair toward cutter teeth of the trimmer for shearing and inhibits the introduction between the cutter teeth of some of the guided strands.

10 Claims, 8 Drawing Figures

THINNING COMB FOR POWERED HAIR TRIMMER

BACKGROUND OF THE INVENTION

This invention relates generally to powered hair trimming devices. The invention relates more particularly to powered hair trimming devices having means for thinning hair.

Powered hair trimmers are known and have been used for trimming a person's hair. In general, motive force is derived from an electrically energized motor and is imparted to cutter teeth which extend from a segment of the hand-held device. The cutter teeth are advanced through the hair style to be cut and shear strands of hair which extend between the teeth. One such device which provides for limiting the length of the hair being cut is disclosed in copending U.S. patent application Ser. No, 825,335 which is filed concurrently herewith and is assigned to the assignee of this invention.

At times it is desirable to thin the hair while maintaining an existing hair styling. For example, over a period of time, natural hair growth results in an increased bulk. It is desirable to simply reduce the bulk of the hair styling through thinning rather than trimming the entire styling.

Although in manual barbering and hair styling, hair thinning shears have been utilized, the use of these shears requires skill which is developed only after extended practice.

Accordingly, it is an object of this invention to provide means for thinning hair with a powered hair trimmer.

Another object of the invention is to provide a means for operating a powered hair trimmer as a thinning hair trimmer.

SUMMARY OF THE INVENTION

In accordance with the general features of the invention, there is provided a powered hair tirmmer having a plurality of cutter teeth for shearing hairs which are introduced between the teeth. A comb means is demountably positioned on the trimmer for guiding hairs toward the cutter teeth and for inhibiting the introduction of some of the guided hairs between the cutter teeth.

In accordance with other features of the invention, the comb means comprises a comb body having a plurality of comb teeth and means for limiting the extension of hairs between some of said plurality of comb teeth.

In accordance with more particular features of the invention, the comb teeth are arranged in a longitudinal array of pairs of teeth, and said comb body includes a plurality of wall members which limit the extension of hairs between the teeth of a pair. Access to the cutter for hairs which are to be sheared is provided by spacings established between adjacent pairs of comb teeth.

BRIEF DESCRIPTION OF THE DRAWING

These and other objects and features of the invention will become apparent with reference to the following specification and to the drawings wherein.

DETAILED DESCRIPTION

Figure 1:
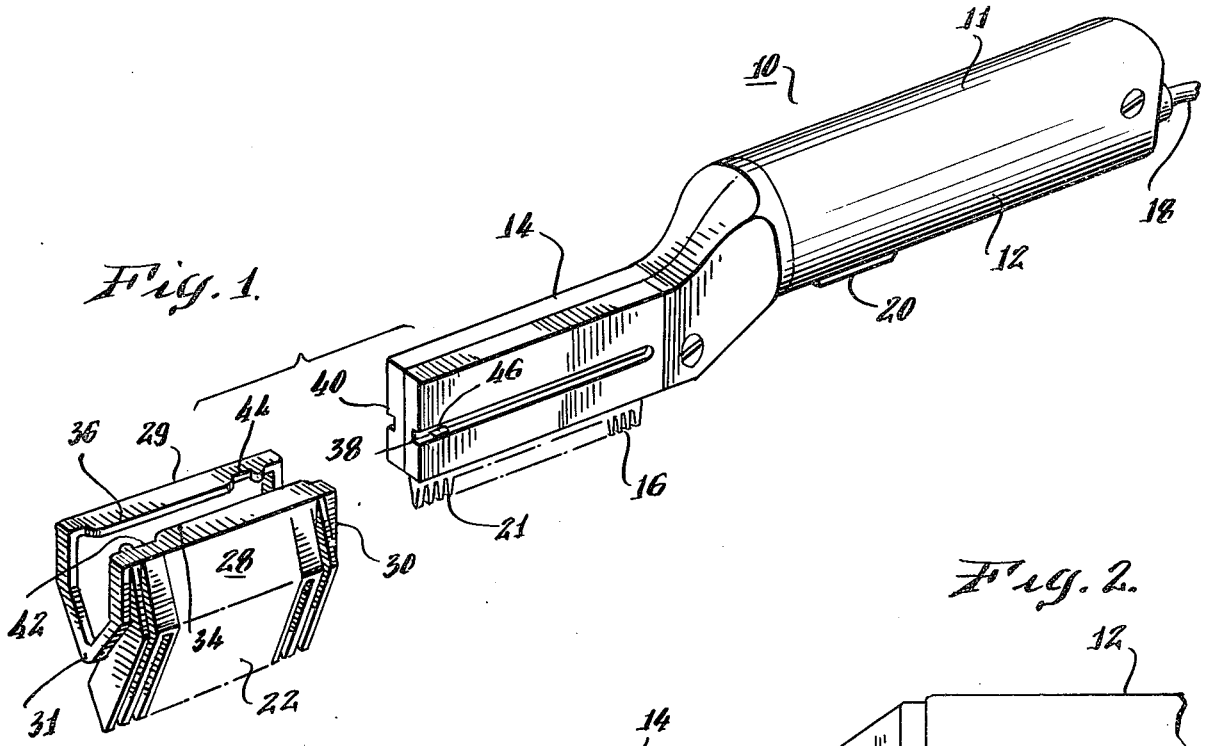
FIG. 1 is a perspective view of a power driven hair trimmer and a demounted comb means constructed in accordance with one embodiment of the present invention.

Referring now to FIG. 1, a powered hair trimmer, referred to generally by reference numeral 10, is shown to have an elongated, hand-held trimmer case 11. Case 11 includes a first case segment 12 for housing an electrical drive means and a second case segment 14 for supporting a cutter assembly which is referred to generally as 16. The hair trimmer is electrically powered by an electric motor (not illustrated) positioned within the handle segment 12 and is energized by batteries, similarly positioned within hand segment 12, or by AC power applied from a line source via input line 18. When the electric motor is energized by operation of a slide switch 20, rotary motion of a motor rotor is converted to reciprocating motion and it is coupled to cutter blades of the assembly 16. As the assembly 16 is transported through a hair styling, those hairs which extend between cutter teeth 21 of the assembly will be sheared. A cutter assembly 16 is described in greater detail in the aforementioned U.S. patent application, the disclosure of which is incorporated herein by reference. While the hair trimmer 10 may be utilized as illustrated in FIG. 1 for trimming hair stylings, it is preferable to limit the length of the hair cut and a means for use with the trimmer which provides for limiting the length of hair cut is described in the referred-to copending application.

Figure 2:
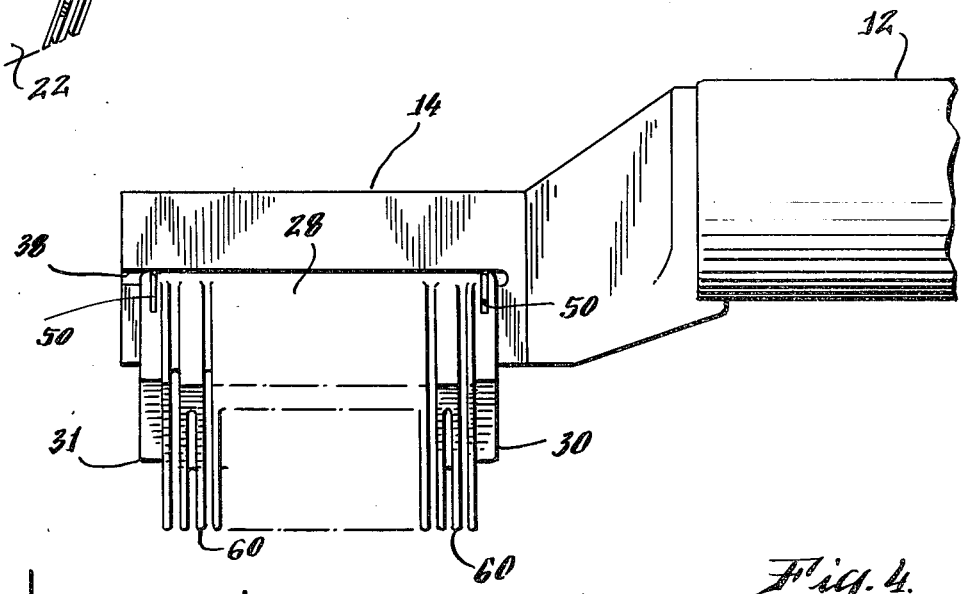
FIG. 2 is an enlarged, fragmentary, side elevation view of the hair trimmer device of FIG. 1.
Figure 4:
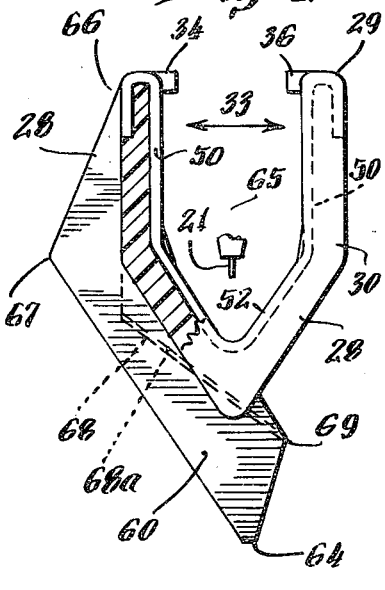
FIG. 4 is a side elevation view, partly broken away and partly in section, of the comb of FIG. 3.
Figure 5:
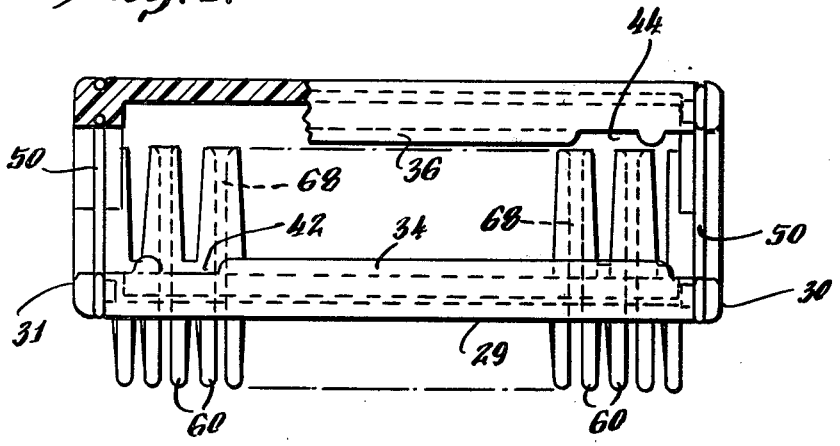
FIG. 5 is a plan view, partly broken away and partly in section, of the comb of FIG. 3.
Figure 6:
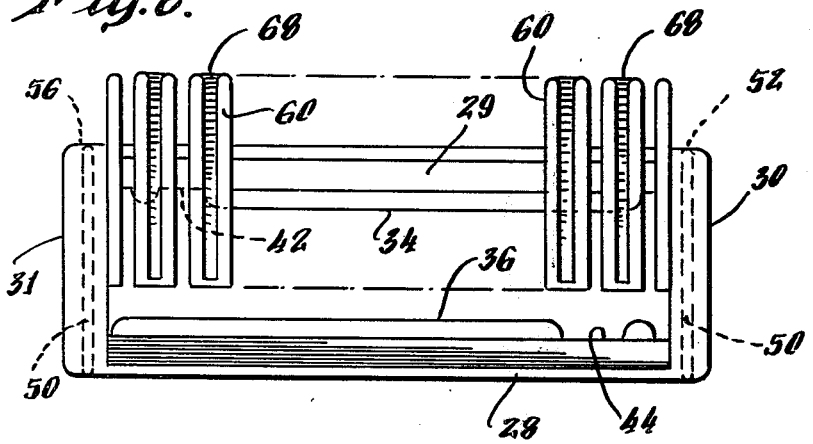
FIG. 6 is a bottom view, partly in section, of the comb of FIG. 3.

A thinning comb means comprising a comb body 22, which as illustrated in FIG. 2, is demountably positioned on the hair trimmer for transport therewith. The comb means is adapted to guide hairs toward the cutter teeth of the cutter assembly 16 and to inhibit the introduction of some of the guided hairs between the cutter teeth. The comb body 22 includes means for mounting the body to the trimmer 10. This mounting means comprises an elongated body segment 28, an elongated frame segment 29, and a pair of generally U-shaped segments 30 and 31 which are formed integrally with the frame and body segments at distal locations along the length of the comb body. The comb is sized and formed of a material for imparting a resilience or slight "give" in a lateral direction as is indicated by the arrows 33 in FIG. 4. One suitable material is a polymer plastic, as for example Nylon. The segments 28, 29, 30 and 31 are configured to conform with the shape of support segment 14. The mounting means further includes, as illustrated in FIGS. 1 and 4, the segment 14 of the trimmer 10 which has a generally rectangular shaped configuration having longitudinally extending grooves 38 and 40 formed in opposed sides thereof. Elongated, laterally extending ridges 34 and 36 are integrally formed with body segments 28 and 29 respectively and engage grooves 38 and 40 respectively. The comb body 22 is mounted to the hair trimmer 10 as illustrated in FIG. 1 by aligning the ridges 34 and 36 of the comb body with the grooves 38 and 40 of the support segment, and sliding the comb with these ridges and grooves in engagement onto the support segment 14. The comb body ridges 34 and 36 each include recesses 42 and 44 respectively formed for engaging bosses positioned in the grooves 38 and 40 respectively. A boss 46 is illustrated positioned in the groove 38 in FIG. 1. A similar boss, not illustrated, is positioned in the groove 40. The recesses 42 and 44 and the corresponding engaging bosses of the grooves 38 and 40 respectively position and retain the comb on the support segment 14.

Figure 9:
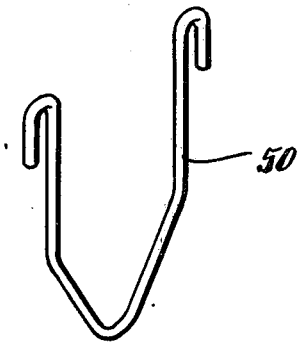
FIG. 9 is a perspective view of a resilient stiffener utilized with the comb of FIG. 3.
Figure 7:
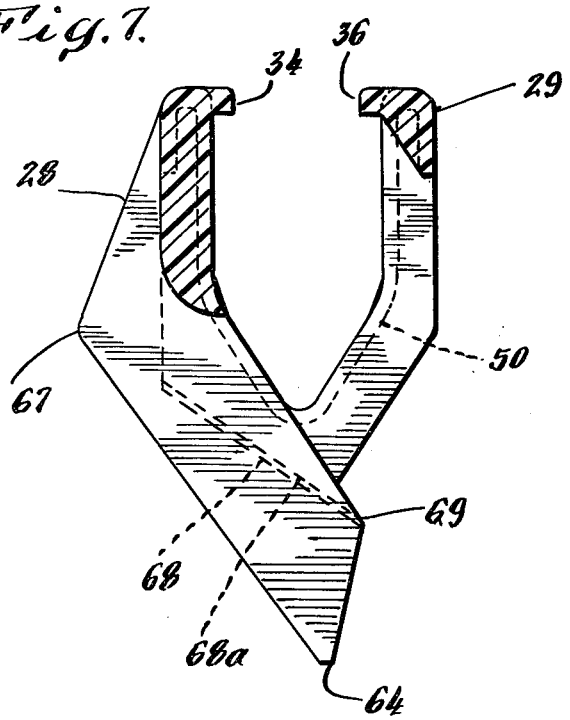
FIG. 7 is a view taken along lines 7—7 of FIG. 3.

The resilience of the U-shaped comb support means is enhanced by the use of a generally U-shaped wire clip 50 (FIG. 9) which is positioned and held in a U-shaped groove 52 (FIG. 4) formed in the U-shaped body segment 30 and a similar clip positioned in a similar groove 56 in the U-shaped segment 31.

Figure 3:
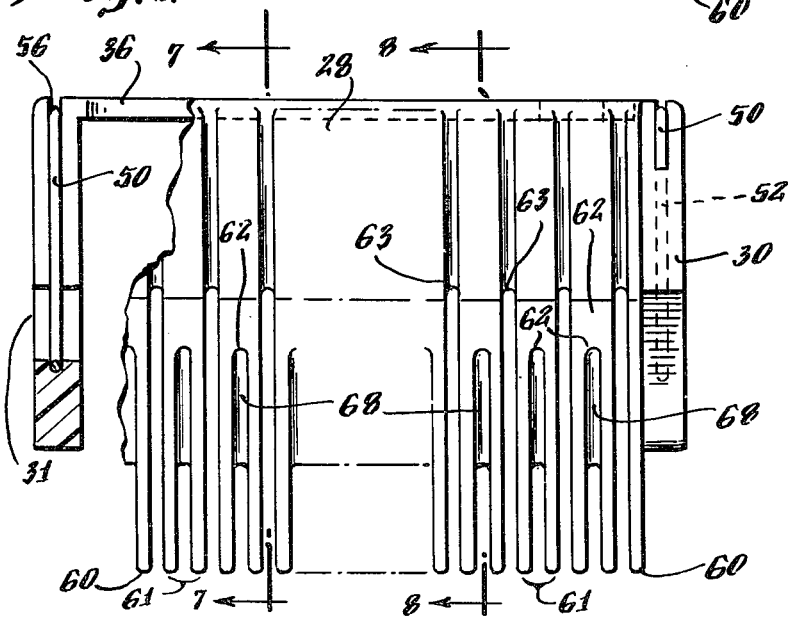
FIG. 3 is an enlarged, side elevation view, partly broken away and partly in section, of a thinning comb utilized with the hair trimmer device of FIG. 2.

The comb body 22 further includes a plurality of comb teeth 60 (FIG. 3) extending from the body segment 28 and terminating in free ends or tips 64. The plurality of teeth 60 are positioned in a longitudinally extending array. The teeth 60 are arranged in pairs 61 and the spacing or notches 62 formed between the teeth of a pair is greater than the spacing or slots 63 formed between the teeth of adjacent pairs. The teeth 60 depend from the body segment 28 and are formed at an angle therewith as illustrated in FIG. 4 for providing that the tips 64 of the teeth extend beyond a center line 65 of the cutter teeth 21. The slots 63 extend substantially from an upper edge 66 (FIG. 4) of the segment 28 while the notches 62 extend from a location adjacent to a ridge 67 in the comb body.

Figure 8:
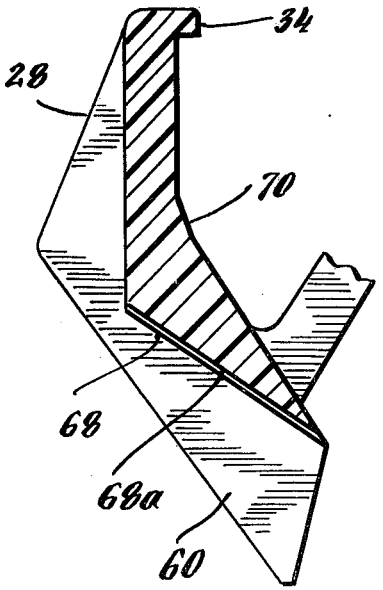
FIG. 8 is a fragmentary view taken along lines 8—8 of FIG. 3.

A means is provided for limiting the extension of hairs between some of the plurality of comb teeth as the comb, when supported on the trimmer 10, is transported through a hair styling. This means comprises comb body wall segments 68 having a concave surface **68*a* which extend across the width or distance between a pair of teeth 61 and extend along the length of the tooth to a location 69 (FIG. 4) laterally displaced from the center line 65 of the cutter teeth. When the comb is transported through a hair styling, hair will be guided by the notches and slots 62 and 63 formed between the different teeth of the comb. However, because of the existence of the wall segment 68 between teeth of a pair, hairs which are guided by notches 62 are limited from extending fully between the comb teeth and are inhibited from introduction between the cutter teeth. On the other hand, the slots 63 are free openings providing an unlimited passageway between the comb teeth to the cutter teeth and hairs which are guided by these slots will extend fully therethrough and are introduced between the cutter teeth where such hairs will then be sheared. By providing slots 63 which have a width ($W_2$) in the direction of the tooth array which is relatively more narrow than the width ($W_1$) of the notches 62, the quantity of hair which is allowed to extend between the cutter teeth is substantially limited, relative to the quantity or bulk of hair which is guided by the comb teeth as the trimmer and comb are transported through a hair styling. The notches 62 prevent an excessive number of hair strands from entering and jamming the slots 63. Concave surface 68*a* of wall segment 68 additionally imparts a rolling action to hair strands as the comb teeth are moved through the hair styling to form a rope-like bundle of hair in notches 62 thus providing for a smooth combing and feeding action through the hair of the user without snagging or pulling of the hair from the scalp. Hairs which are guided into the slot 63 and extend between the cutter teeth assume that position by virtue of a force applied to this strand at a location 70 (FIG. 8**) as is described and claimed in the aforementioned copending application.

The described hair thinning arrangement advantageously provides for the thinning of hair with a powered hair trimmer. A hair style is combed with the thinning comb positioned on the hair trimmer and as the comb and trimmer are advanced through the hair style, hair strands are guided by the comb piece toward the cutter teeth of the hair trimmer. However, only a limited number of the hair strands are permitted to extend between the comb teeth and to be introduced between cutter teeth for shearing. Thus a relatively bulky hair styling can be thinned without altering the hair style. The comb is readily demounted enabling the hair trimmer to be utilized for trimming.

While there has been described a particular embodiment of the invention, it will be apparent to those skilled in the art that variations may be made thereto without departing from the spirit of the invention and the scope of the appended claims.

What is claimed is:

1. A thinning comb for a hair trimmer for thinning hair, said hair trimmer having an elongated row of cutter teeth for shearing hair strands introduced between said cutter teeth, said thinning comb comprising;

a. an elongated comb member having a plurality of elongated comb teeth terminating at free end portions, said comb member including an elongated upper edge portion and an elongated ridge portion, said ridge portion being located intermediate said edge portion and the free end portions of said comb teeth, said comb teeth extending from said ridge portion at a transverse angle with respect to the length of said comb member, said free end portions of the comb teeth extending transverse of and beyond the row of cutter teeth, b. means formed on said comb member for demountably positioning said comb member on said hair trimmer for transport therewith through hair to be thinned, c. said comb teeth adapted for guiding hair strands toward said cutter teeth for introducing some of the guided hair strands between the cutter teeth, d. means formed between alternate pairs of said comb teeth for inhibiting introduction of hair strands between some of said cutter teeth, and e. means formed between and extending longitudinally of said alternate pairs of the comb teeth for imparting a rolling action to the hair strands guided by said alternate pairs of the comb teeth thereby providing a smooth combing and feeding action of the comb member upon transport through the hair to be thinned.

2. The thinning comb of claim 1 wherein a notch is formed between each of said alternate pairs of the combing teeth, said notch extending from a location adjacent said ridge portion of the comb member to said free end portions of the comb teeth, said inhibiting means comprising a wall segment of said notch extending across the width of said notch and extending in the direction of the length of said alternate pairs of the comb teeth.

3. The thinning comb of claim 2 wherein said means for imparting a rolling action include a concave surface formed coextensive with said wall segment.

4. The thinning comb of claim 3 wherein a slot is formed between each of the remaining pair of the comb teeth, said slots extending substantially from said upper edge portion of the comb member to said free end portions of the comb teeth, said slot being a free opening providing unlimited passageway between said remaining pairs of the comb teeth for hair strands guided in said slots for introduction between said cutter teeth.

5. The thinning comb of claim 3 wherein said wall segment extends to said free end portions of the comb teeth and said concave surface extends the length of said wall segment.

6. A thinning comb for a hair trimmer for thinning hair, said hair trimmer having an elongated row of cutter teeth for shearing hair strands introduced between said cutter teeth, said thinning comb comprising;

a. an elongated comb member having a plurality of elongated comb teeth terminating at free end portions, b. means formed on said comb member for demountably positioning said comb member on said hair trimmer for transport therewith through hair to be thinned, wherein said hair trimmer includes a support member for supporting said elongated row of cutter teeth, and wherein said mounting means include a pair of resilient U-shaped segments formed at distal locations along the length of said comb member, said support member having a generally rectangular configuration and longitudinally extending grooves formed in opposed sides thereof, said U-shaped segments having opposed ridges formed thereon extending in a lateral direction for detachable mating engagement with said grooves, c. said comb teeth adapted for guiding hair strands toward said cutter teeth for introducing some of the guided hair strands between the cutter teeth, d. means formed between alternate pairs of said comb teeth for inhibiting introduction of hair strands between some of said cutter teeth, and e. means formed between and extending longitudinally of said alternate pairs of the comb teeth for imparting a rolling action to the hair strands guided by said alternate pairs of the comb teeth thereby providing a smooth combing and feeding action of the comb member upon transport through the hair to be thinned.

7. The thinning comb of claim 6 wherein said ridges include recesses formed therein, and said grooves include bosses positioned therein, said recesses engaging said bosses to position and retain said comb member with respect to said cutter teeth.

8. The thinning comb of claim 6 wherein each of said U-shaped segments include U-shaped grooves formed therein for positioning and holding a generally U-shaped wire clip for enhancing the resiliency of said U-shaped segments.

9. An improved power driven hair trimmer for thinning hair comprising;

a. a power driven hair trimmer including a support member having a generally rectangular configuration and longitudinally extending grooves formed in opposed side thereof, said grooves including bosses positioned therein, said support member supporting a cutter assembly having cutter teeth for shearing hairs which are introduced between said cutter teeth, b. a comb member having an elongated body portion and a plurality of teeth extending from said body portion, said body portion including a pair of resilient generally U-shaped segments formed at distal locations along the length of said body portion, said U-shaped segments having ridges formed thereon in a lateral direction, said ridges include recesses formed therein, c. said recesses engaging said bosses to retain said ridges in detachable mating engagement with said grooves to position said comb member with respect to said cutter teeth to guide hairs extending between said comb teeth to said cutter teeth upon transport of the mounted comb member through hair which is to be thinned, and d. means on said body portion for limiting the extension of hairs between some of said comb teeth to inhibit said limited hairs from introduction between said cutter teeth.

10. An improved power driven hair trimmer for thinning hair comprising;

a. a power driven hair trimmer including a support member having a generally rectangular configuration and longitudinally extending grooves formed in opposed sides thereof, said support member supporting a cutter assembly having cutter teeth for shearing hairs which are introduced between said cutter teeth, b. a comb member having an elongated body portion and a plurality of teeth extending from said body portion, said body portion including a pair of resilient generally U-shaped segments formed at distal locations along the length of said body portion, said U-shaped segments having ridges formed thereon in a lateral direction and include U-shaped grooves formed therein for positioning and holding a generally U-shaped wire clip for enhancing the resiliency of said U-shaped segment, c. said ridges for detachable mating engagement with said grooves on the support member for demountably positioning said comb teeth with respect to said cutter teeth to guide hairs extending between said comb teeth to said cutter teeth upon transport of the mounted comb member through hair which is to be thinned, and d. means on said body portion for limiting extension of hairs between some of said comb teeth to inhibit said limited hair from introduction between said cutter teeth.

* * * * *